US008711057B2

(12) United States Patent
Chen et al.

(10) Patent No.: US 8,711,057 B2
(45) Date of Patent: Apr. 29, 2014

(54) COLOR LED DISPLAY DEVICE WITHOUT COLOR SEPARATION

(75) Inventors: Cheng-Huan Chen, Taoyuan County (TW); Shu-Hui Chu, Taipei (TW); Kuang-Lung Huang, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 152 days.

(21) Appl. No.: 13/410,363

(22) Filed: Mar. 2, 2012

(65) Prior Publication Data

US 2012/0229532 A1 Sep. 13, 2012

(30) Foreign Application Priority Data

Mar. 11, 2011 (TW) ..... 100108313 A

(51) Int. Cl.
*G09G 5/00* (2006.01)
*G09G 3/00* (2006.01)

(52) U.S. Cl.
USPC ..... 345/1.1; 345/1.3; 345/3.2

(58) Field of Classification Search
USPC ..... 345/1.1–1.3, 2.1–2.2, 30–52, 5, 6
See application file for complete search history.

(56) References Cited

U.S. PATENT DOCUMENTS

2002/0006040 A1* 1/2002 Kamada et al. ..... 362/237
2006/0170616 A1* 8/2006 Hirayama et al. ..... 345/32
2009/0213585 A1* 8/2009 Chern et al. ..... 362/231
2011/0102304 A1* 5/2011 Nelson ..... 345/46

OTHER PUBLICATIONS

Applicant's Admitted Prior Art (paragraphs [0002-0007} Figs. 1-4.*

* cited by examiner

*Primary Examiner* — Duc Dinh

(57) ABSTRACT

A color LED display device without color separation comprises a substrate, a plurality of display units, a power supply unit, and a control unit. Each display unit comprises a driving chip, at least one red-light LED chip, at least one green-light LED chip, at least one blue-light LED chip, and a micro optical device assembly. The micro optical device assembly is disposed above the red-light, green-light and blue-light LED chips. When the control unit controls the display unit to emit light, the red-light, green-light and blue-light LED chips emit red, green and blue lights respectively and simultaneously. The red, green and blue lights pass through the micro optical device assembly, such that the light paths of the red, green and blue lights are changed and the three lights are combined on a two-dimensional plane. Therefore, the color separation phenomenon of the conventional color LED display device is solved.

18 Claims, 11 Drawing Sheets

COLOR LED DISPLAY DEVICE WITHOUT COLOR SEPARATION

CROSS-REFERENCE TO RELATED APPLICATION

This application claims foreign priority from a Taiwan Patent Application, Ser. No. 100108313, filed on Mar. 11, 2011.

BACKGROUND OF THE INVENTION

1. Field of the Invention

The present invention relates to a color LED display device, in particular to the color LED display device using a micro optical device assembly to change a light path, such that red light, green light and blue light can be combined onto a two-dimensional plane to improve the color separation phenomenon.

2. Description of the Related Art

In recent years, light emitting diode (LED) is used extensively in LED illumination device, LED display device and LED backlight module, wherein the LED display device is commonly used in advertising billboards and traffic indicating devices. With reference to FIG. 1 for the architecture of a conventional monochrome LED display device, the conventional monochrome LED display device 10' generally comprises a main frame 109', at least one display module 105', at least one cable 106', at least one connector 107', and at least one main control module 108', wherein the conventional monochrome LED display device 10' as shown in FIG. 1 has three display modules 105' and two connectors 107', and the display module 105' has a plurality of monochrome LED components 1051'. The cable 106' is electrically coupled to the three display modules 105' and the main control module 108'. The main control module 108' comprises a control unit 1081' and a power supply unit 1082', wherein the power supply unit 1082' can supply a power source to the LED component 1051'; the control unit 1081' can control all LED components 1051' to emit light or turn off. Therefore, the display module 105' can display specific numbers, graphics or texts.

Since the monochrome LED display device cannot display color numbers, graphics or texts, therefore LED display device manufacturers introduce a color LED display device. With reference to FIG. 2 for a perspective view of a conventional color LED display device, the conventional color LED display device 1*a* comprises: a substrate 10*a*, a flexible circuit board 30*a* and a plurality of LED display units 20*a*, wherein the substrate 10*a* includes two power supply holes 11*a*.

With reference to FIG. 3 for a perspective view of an LED display unit of a conventional color LED display device, the LED display unit 20*a* further comprises: a casing 201*a*, a driving chip 202*a*, a green light LED chip 203*a*, a red light LED chip 204*a*, and a blue light LED chip 205*a*, wherein the green light LED chip 203*a*, the red light LED chip 204*a* and the blue light LED chip 205*a* are coupled to the driving chip 202*a*, and represent pixel respectively. The green light LED chip 203*a*, the red light LED chip 204*a* and the blue light LED chip 205*a* are driven by the driving chip 202*a* to emit light. In FIG. 2, when a portion or all of the LED display units 20*a* emit light, the conventional color LED display device 1*a* can display color numbers, graphics or texts.

With reference to FIG. 4 for a cross-sectional side view of the conventional color LED display device, the conventional color LED display device 1*a* comes with a simple structure and a low manufacturing cost. However, the display unit 20*a* as shown in FIG. 4 does not have other optical components such as the refractive lens, so that when the driving chip 202*a* drives the green light LED chip 203*a*, the red light LED chip 204*a* and the blue light LED chip 205*a* in the display unit 20*a* to emit light, a green light G', a red light R' and a blue light B' will not be refracted by emitted directly from the display unit 20*a*, and the green light G', the red light R' and the blue light B' cannot be combined on a two-dimensional plane. As a result, when a user views the images at a near distance, the user will see the three separated color lights of the conventional color LED display device 1*a*. In other words, the conventional color LED display device 1*a* has the drawback of the color separation phenomenon.

In addition the light emission of the LED chip will generate heat, so that the distance between the green light LED chip 203*a*, the red light LED chip 204*a* and the blue light LED chip 205*a* of the conventional color LED display device 1*a* is generally too short, and the distance between two adjacent LED chips must be over 0.2 mm, and thus the method of reducing the distance between the LED chips in order to overcome the color separation problem of the conventional color LED display device 1*a* cannot be used.

In view of the aforementioned problems of the conventional monochrome LED display device and color LED display device that cannot display color numbers, graphics or texts and having the color separation phenomenon, the inventor of the present invention conducted extensive researches and experiments, and finally developed a color LED display device without color separation in accordance with the present invention to overcome the drawbacks of the prior art.

SUMMARY OF THE INVENTION

Therefore, it is a primary objective of the present invention to provide a color LED display device without color separation, wherein a micro optical device assembly is installed above the red-light LED chip, the green-light LED chip and the blue-light LED chip in the display unit and provided for refracting and changing the light paths of the red light, the green light and the blue light to further combine the three color lights onto a two-dimensional plane, so as to improve the color separation phenomenon of the conventional color LED display device.

To achieve the foregoing objective, the inventor of the present invention provides a color LED display device without color separation, comprising:

a substrate, having a plurality of conductive wires laid thereon;

a plurality of display units, arranged in form of an array on the substrate, and coupled to the plurality of conductive wires, and each display unit comprising:

a driving chip;

at least one red-light LED chip, coupled to the driving chip for emitting a red light;

at least one green-light LED chip, coupled to the driving chip for emitting a green light;

at least one blue-light LED chip, coupled to the driving chip for emitting a blue light; and a micro optical device assembly, installed above the red-light LED chip, the green-light LED chip and the blue-light LED chip;

a power supply unit, coupled to the substrate, for supplying a power source to the plurality of display units; and a control unit, coupled to substrate, for controlling the plurality of display units to emit light;

thereby, when the control unit controls the display unit to emit light, the red-light LED chip, the green-light LED chip and the blue-light LED chip emit red light, green light and blue light simultaneously, and the red light, the green light and the blue light pass through the micro optical device assembly to change their light paths, and the red light, the green light and the blue light are combined on a two-dimensional plane.

Another objective of the present invention is to provide a color LED display device without color separation, wherein a micro optical device assembly is installed above the red-light LED chip, the green-light LED chip and the blue-light LED chip in the display unit and a directional optical device assembly is installed above the display unit, and the micro optical device assembly is provided for refracting and changing the light paths of the red light, the green light and the blue light to further combine the three color lights onto a two-dimensional plane, so as to improve the color separation phenomenon of the conventional color LED display device. In the meantime, the directional optical device assembly can display 3D images from the color LED display device.

To achieve the aforementioned objective, the inventor of the present invention provides a color LED display device without color separation, comprising:

a substrate, having a plurality of conductive circuits laid thereon;

a plurality of display units, arranged in form of an array on the substrate, and coupled to the plurality of conductive circuits, and each display unit comprising:

a driving chip;

at least one red-light LED chip, coupled to the driving chip for emitting a red light;

at least one green-light LED chip, coupled to the driving chip for emitting a green light;

at least one blue-light LED chip, coupled to the driving chip for emitting a blue light; and a micro optical device assembly, installed above the red-light LED chip, the green-light LED chip and the blue-light LED chip;

a power supply unit, coupled to the substrate, for supplying a power source to the plurality of display units;

a control unit, coupled to substrate, for controlling the plurality of display units to emit light; and a directional optical device assembly, installed above the plurality of display units;

thereby, when the control unit controls the display unit to emit light, the red-light LED chip, the green-light LED chip and the blue-light LED chip emit red light, green light and blue light simultaneously, and the red light, the green light and the blue light pass through the micro optical device assembly and change their light paths, and the red light, the green light and the blue light are combined on a two-dimensional plane and emitted from the directional optical device assembly to the outside, and the red light, the green light and the blue light emitted from the directional optical device assembly produce an effect of a 3D image to naked eyes.

DETAILED DESCRIPTION OF THE PREFERRED EMBODIMENTS

The technical content of the color LED display device without color separation in accordance with the present invention will become apparent with the detailed description of the following preferred embodiments accompanied with the illustration of related drawings as follows.

Figure 1:
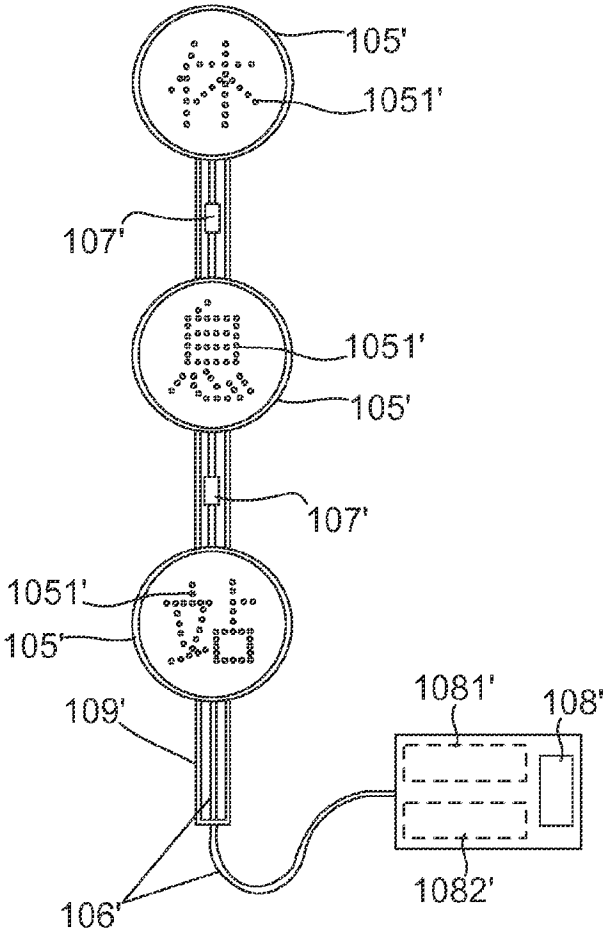
FIG. 1 (Prior Art)
FIG. 1 is a schematic view of the architecture of a conventional monochrome LED display device.
Figure 2:
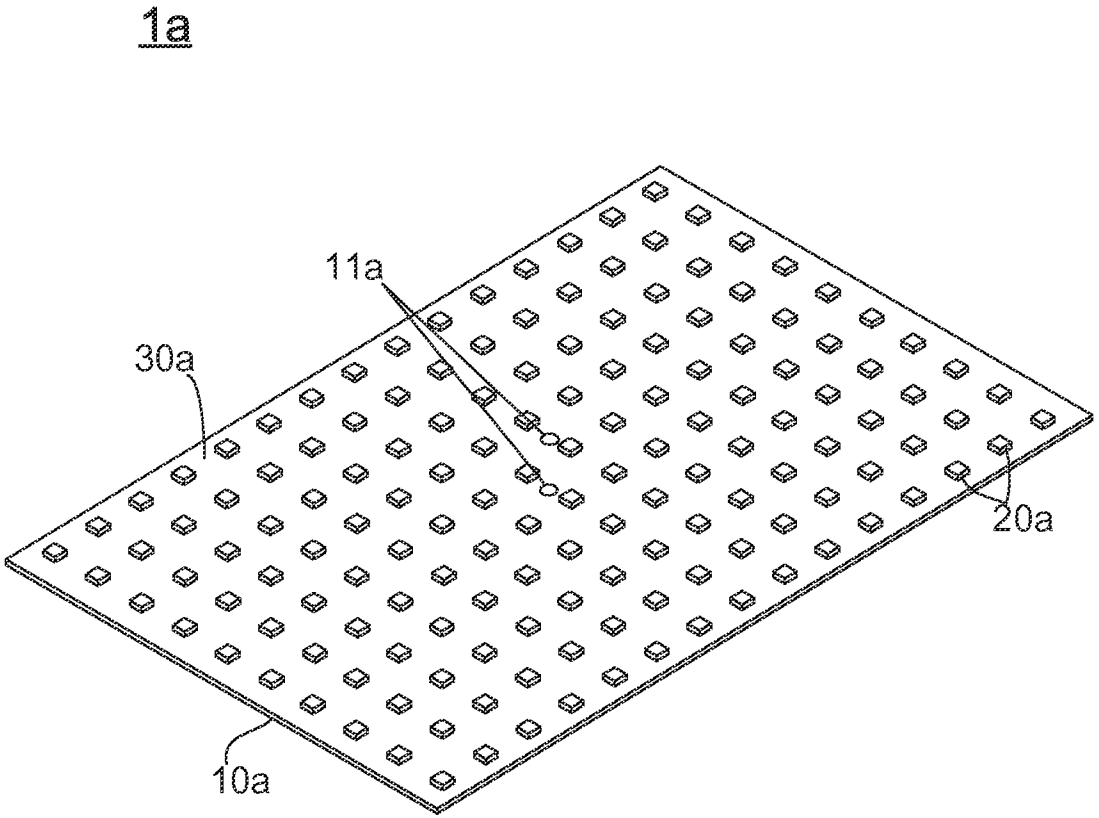
FIG. 2 (Prior Art)
FIG. 2 is a perspective view of a conventional color LED display device.
Figure 3:
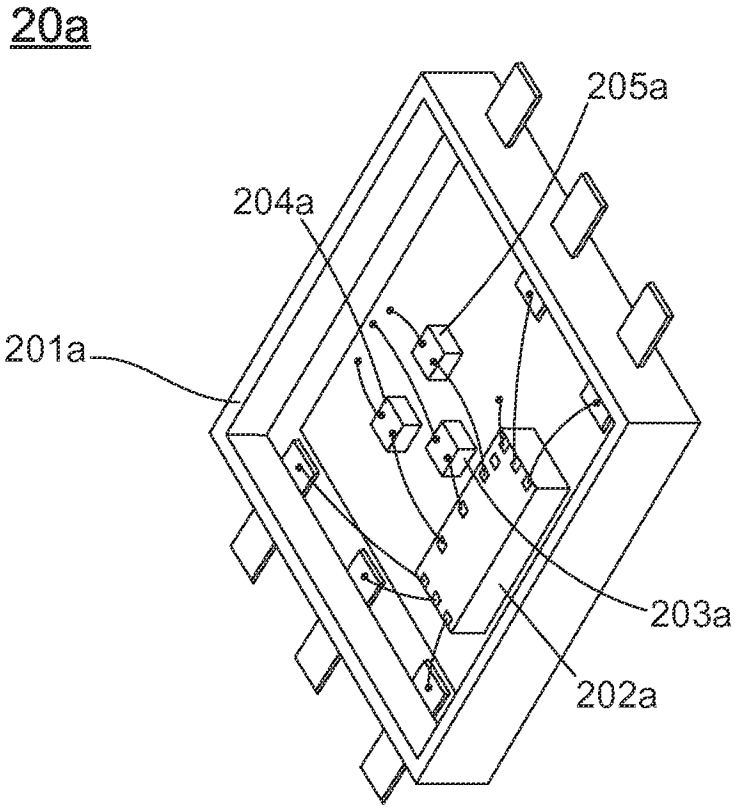
FIG. 3 (Prior Art)
FIG. 3 is a perspective view of an LED display unit of a conventional color LED display device.
Figure 4:
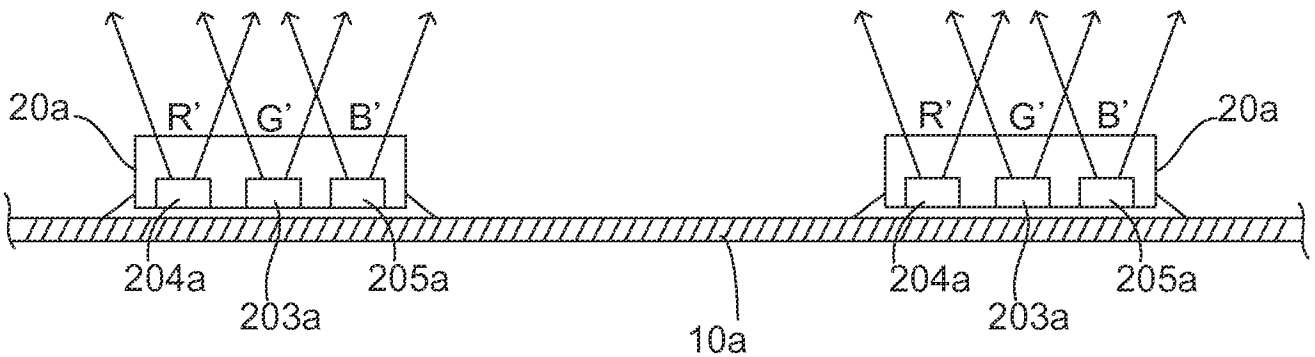
FIG. 4 is a cross-sectional side view of a conventional color LED display device.
Figure 5:
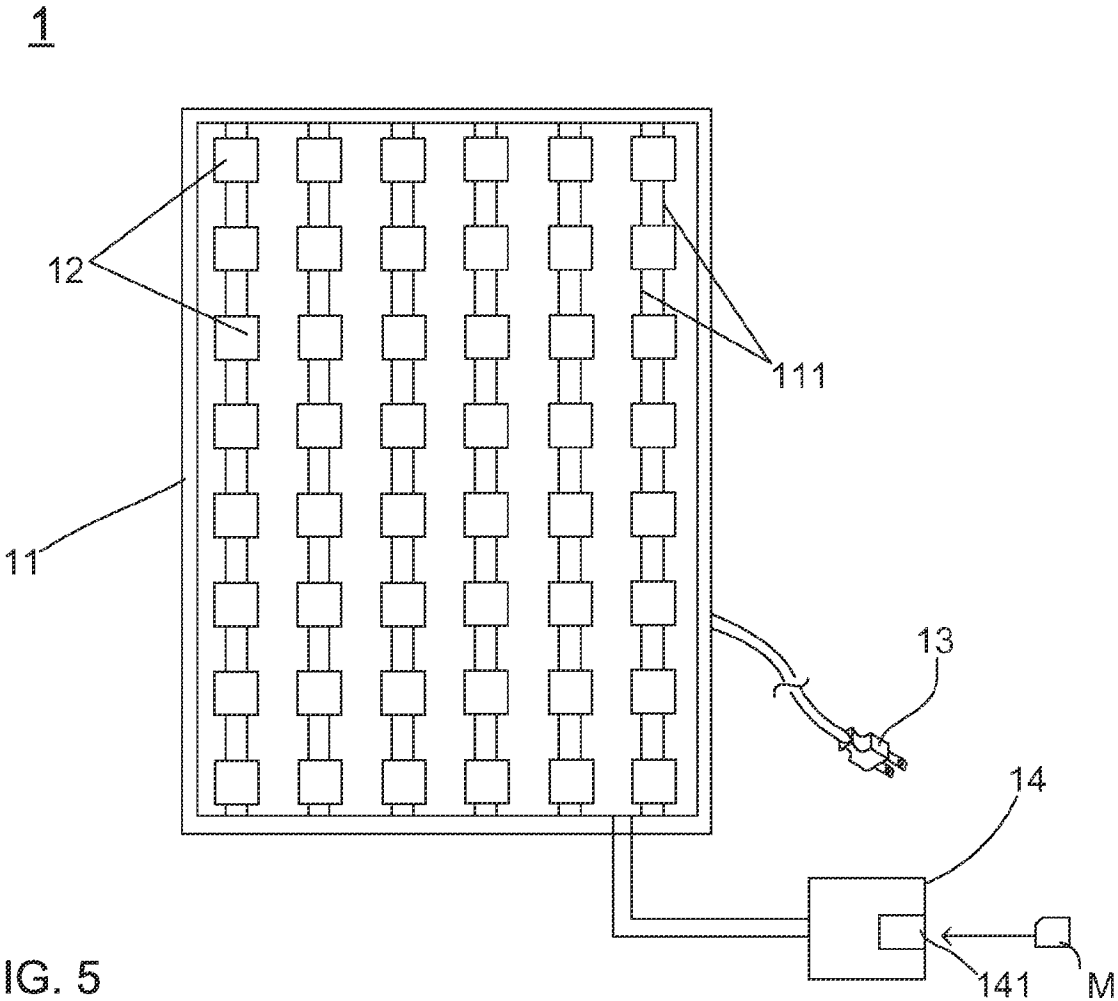
FIG. 5 is a schematic view of the main architecture of a color LED display device without color separation in accordance with a first preferred embodiment of the present invention.

With reference to FIG. 5 for the main architecture of a color LED display device without color separation in accordance with a first preferred embodiment of the present invention, the color LED display device without color separation 1 comprises: a substrate 11, a plurality of display units 12, a power supply unit 13, and a control unit 14. The substrate 11 is a circuit board having a plurality of conductive wires 111 installed on a surface of the circuit board.

Figure 6:
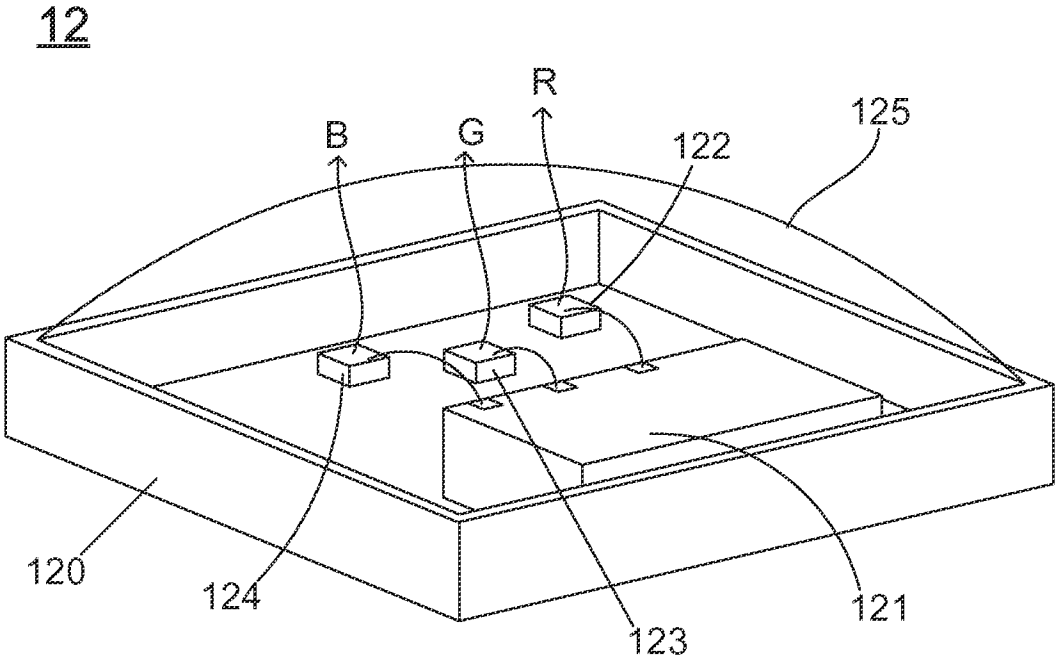
FIG. 6 is a perspective view of a display unit of a color LED display device without color separation in accordance with the first preferred embodiment of the present invention.

With reference to FIG. 6 for the perspective view of a display unit of a color LED display device without color separation in accordance with the first preferred embodiment of the present invention together with FIG. 5, the plural display units 12 are arranged in form of an array on the substrate 11 and coupled to the plurality of conductive wires 111. Each display unit 12 comprises: a driving chip 121; a red-light LED chip 122, coupled to the driving chip 121 for emitting a red light R; a green-light LED chip 123, coupled to the driving chip 121 for emitting a green light G; a blue-light LED chip 124, coupled to the driving chip 121 for emitting a blue light B; and a micro optical device assembly 125, installed above the red-light LED chip 122, the green-light LED chip 123 and the blue-light LED chip 124. In addition, the display unit 12 further comprises a casing 120 for containing the driving chip 121, the red-light LED chip 122, green-light LED chip 123, blue-light LED chip 124, and micro optical device assembly 125. In general, the common light emitting chips include LED chips and OLED chips, and the LED chips and the OLED chips can be adopted in the first preferred embodiment of the color LED display device without color separation 1 to serve as the red-light LED chip 122, the green-light LED chip 123 and the blue-light LED chip 124.

The power supply unit 13 is coupled to the substrate 11 for supplying a power source to the plurality of display units 12. In FIG. 5, the power supply unit 13 is a power connector. For the color LED display device without color separation 1 of the present invention, the power supply unit 13 is not limited to the power connector only, but it can also be a battery or a power supply device. The control unit 14 is coupled to substrate 11 for controlling the plurality of display units 12 to emit light, wherein the control unit 14 can be a computer, an input device or a handwriting input device. In addition, the control unit 14 further comprises a memory card access device 141 for plugging in a memory card M. Therefore, a user can use the control unit 14 to input graphics, numbers, or texts and display them from the color LED display device without color separation 1. Users can selectively save the inputted graphics, numbers, or texts in the memory card through the memory card access device 141.

Figure 7:
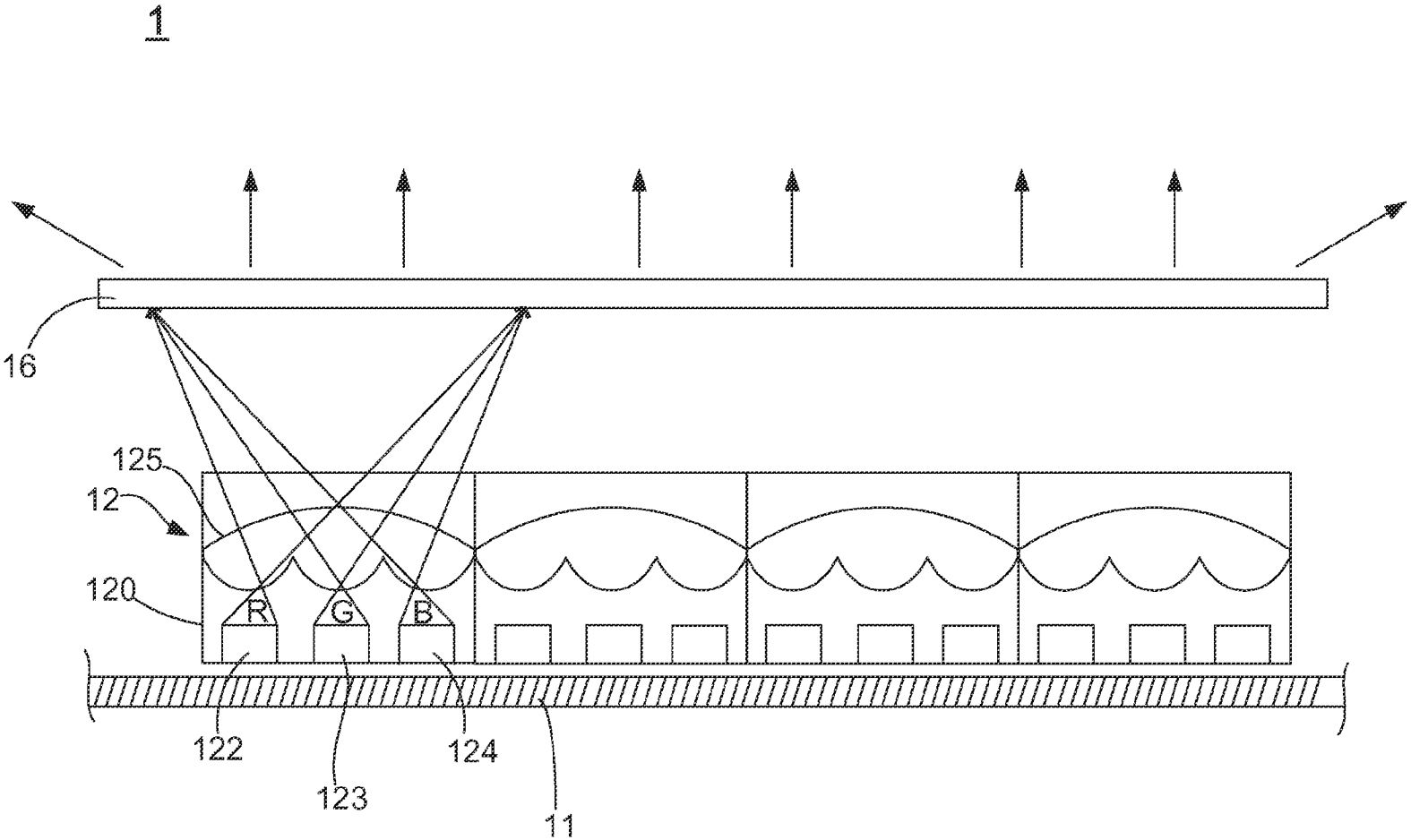
FIG. 7 is a cross-sectional side view of a color LED display device without color separation in accordance with the first preferred embodiment of the present invention.

With reference FIG. 7 for a cross-sectional side view of a color LED display device without color separation in accordance with the first preferred embodiment of the present invention together with FIGS. 5 and 6, the micro optical device assembly 125 installed above the red-light LED chip 122, the green-light LED chip 123 and the blue-light LED chip 124 is a bi-convex lens. In addition, the side facing the red-light LED chip 122, the green-light LED chip 123 and the blue-light LED chip 124 is formed by three secondary plano-convex lenses, and the other side is a primary plano-convex lens.

With reference to FIGS. 5 and 6, when the control unit 14 controls the display unit 12 to emit light, the red-light LED chip 122, the green-light LED chip 123 and the blue-light LED chip 124 will emit red light R, green light G and blue light B simultaneously. Now, the red light R, the green light G and the blue light B will pass through the micro optical device assembly 125 to change their light paths as shown in FIG. 7, and finally the red light R, the green light G and the blue light B will be combined on a two-dimensional plane. Therefore, even when a user views the color LED display device without color separation 1, the user will not see the three separated color lights. In other words, the color LED display device without color separation 1 of the present invention does not have the drawback of the color separation phenomenon. To increase the diffraction angle of the light emitted from the display unit 12, a diffussing unit 16 is installed above the plurality of display units 12 as shown in FIG. 7, and the viewing angle of the color LED display device without color separation 1 can be extended.

Figure 8:
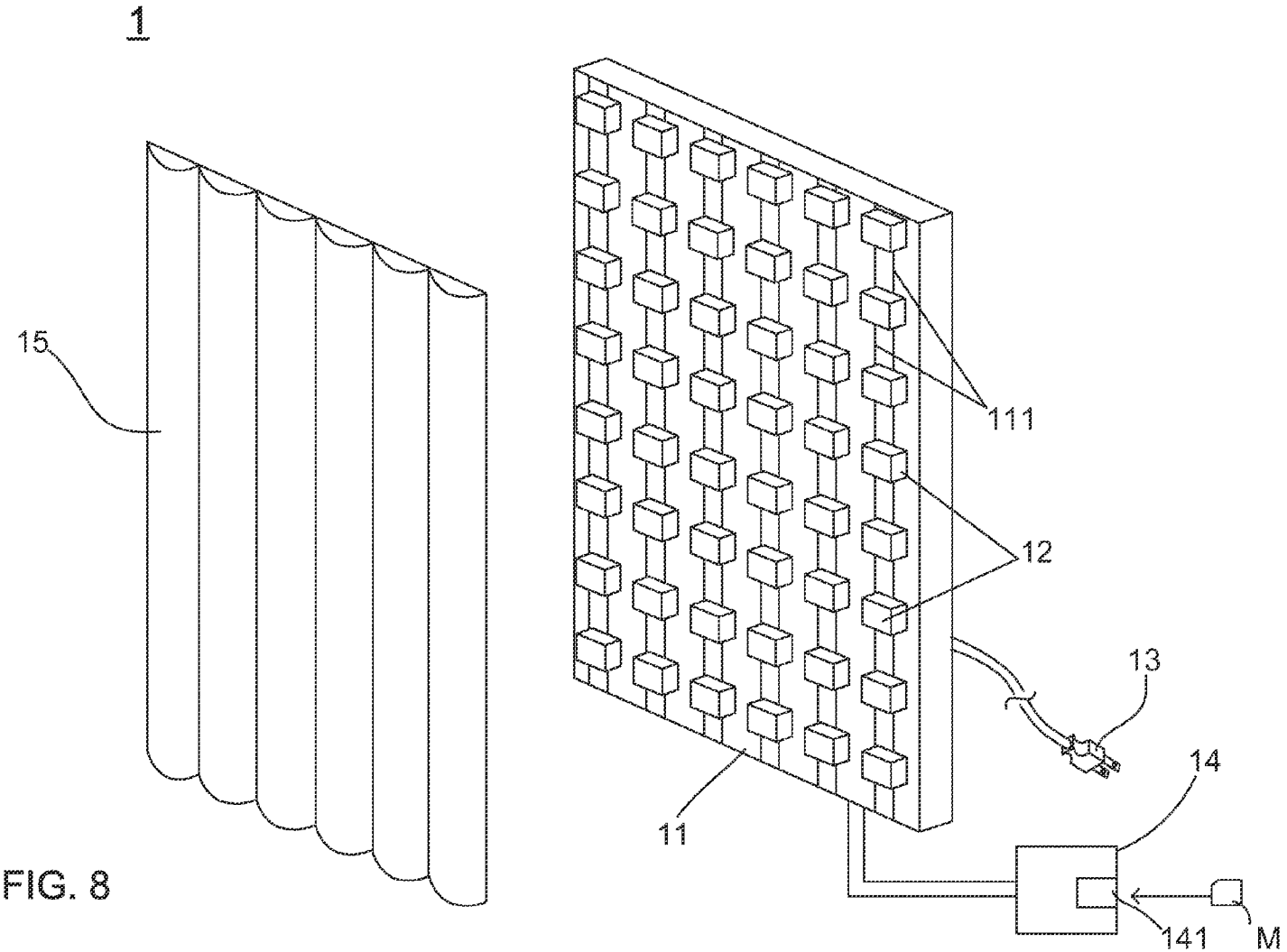
FIG. 8 is a perspective view of a color LED display device without color separation in accordance with a second preferred embodiment of the present invention.

In addition, the present invention further provides a second preferred embodiment of the color LED display device without color separation which further has the function of displaying 3D images. With reference to FIG. 8 for a perspective view of a color LED display device without color separation in accordance with a second preferred embodiment of the present invention together with FIG. 5, basically the color LED display device without color separation 1 of the second preferred embodiment has the same components of the first preferred embodiment and comprises the substrate 11, the plurality of display units 12, the power supply unit 13, and the control unit 14, except that the color LED display device without color separation 1 of the second preferred embodiment further comprises a directional optical device assembly 15 installed above the plurality of display units 12, wherein the directional optical device assembly 15 is a micro-cylindrical lens array or a parallax mask.

Figure 9:
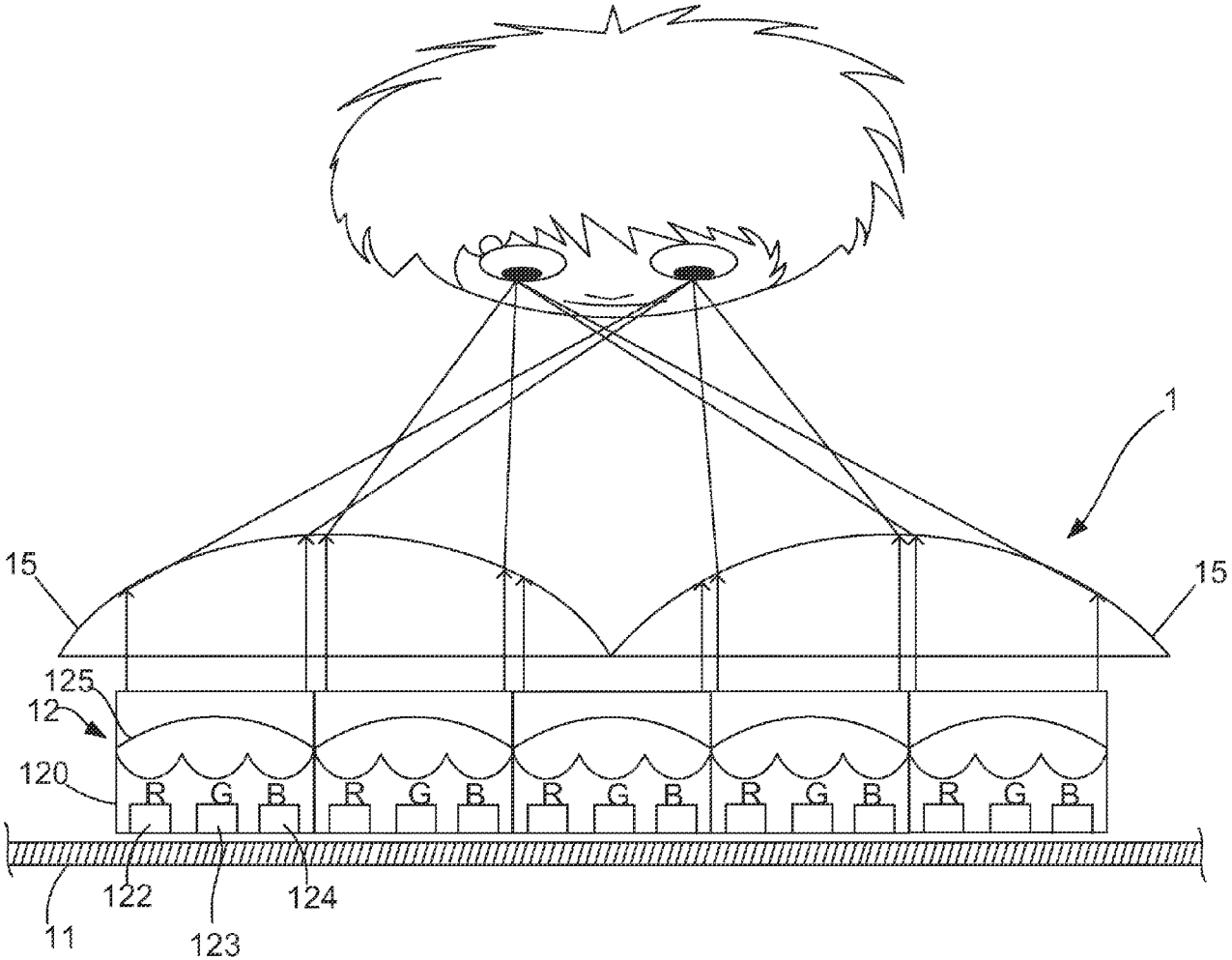
FIG. 9 is a cross-sectional side view of a color LED display device without color separation in accordance with the second preferred embodiment of the present invention.

With reference to FIG. 9 for a cross-sectional side view of a color LED display device without color separation in accordance with the second preferred embodiment of the present invention together with FIG. 8, the directional optical device assembly 15 is a micro-cylindrical lens array. In FIG. 9, when the display unit 12 emits light, the red-light LED chip 122, the green-light LED chip 123 and the blue-light LED chip 124 emit the red light R, the green light G and the blue light B simultaneously, and the red light R, the green light G and the blue light B will pass through the micro optical device assembly 125 to change their light paths, and finally the red light R, the green light G and the blue light B will be combined on a two-dimensional plane and refracted from the micro-cylindrical lens array (or the directional optical device assembly 15) and emitted to the outside. Now, the combined light of the red light R, the green light G and the blue light B is received by naked eyes to produce different visual images to the user's left and right eyes, so as to provide a 3D image effect.

Figure 10:
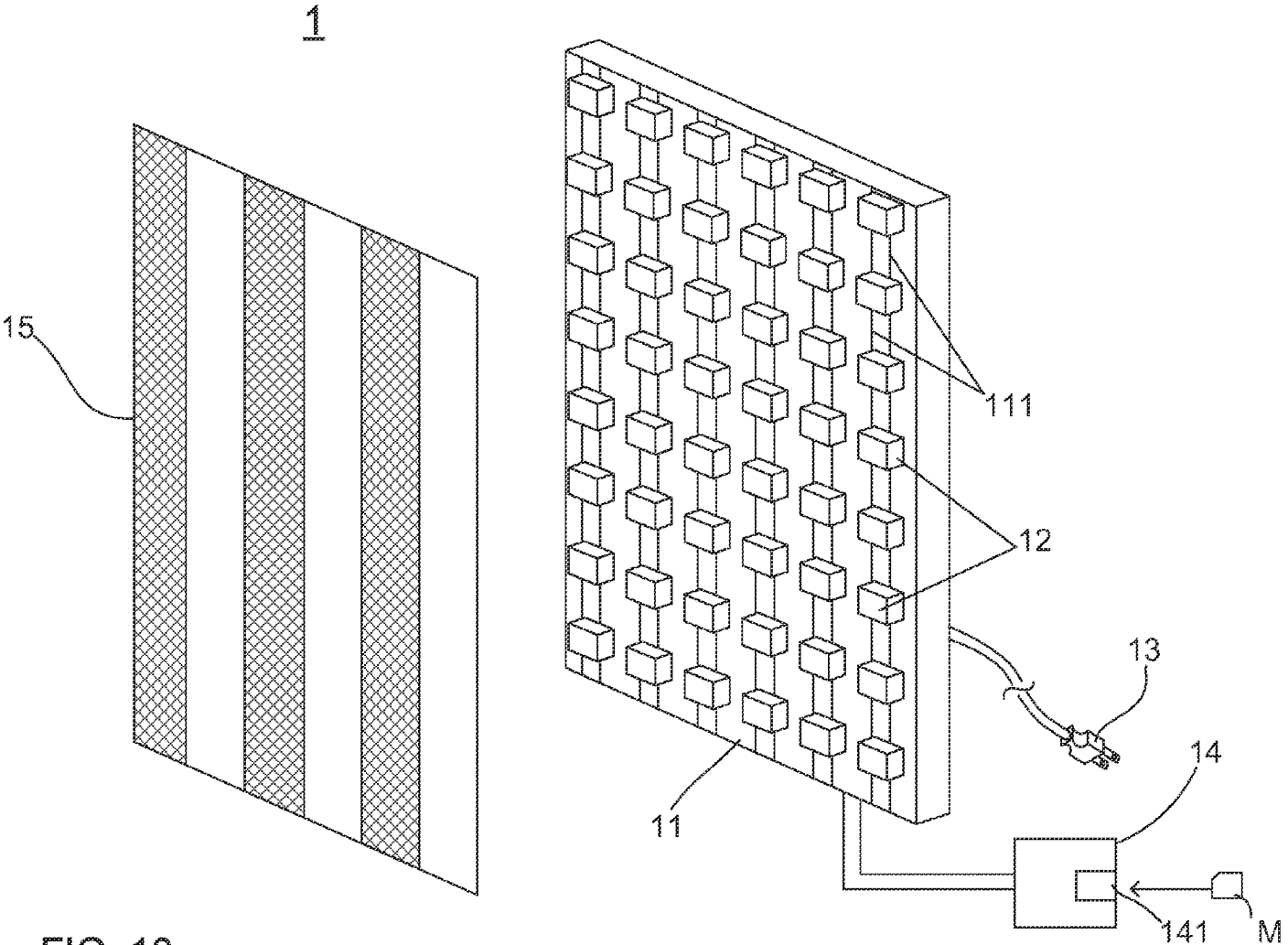
FIG. 10 is another perspective view of a color LED display device without color separation in accordance with a second preferred embodiment of the present invention.
Figure 11:
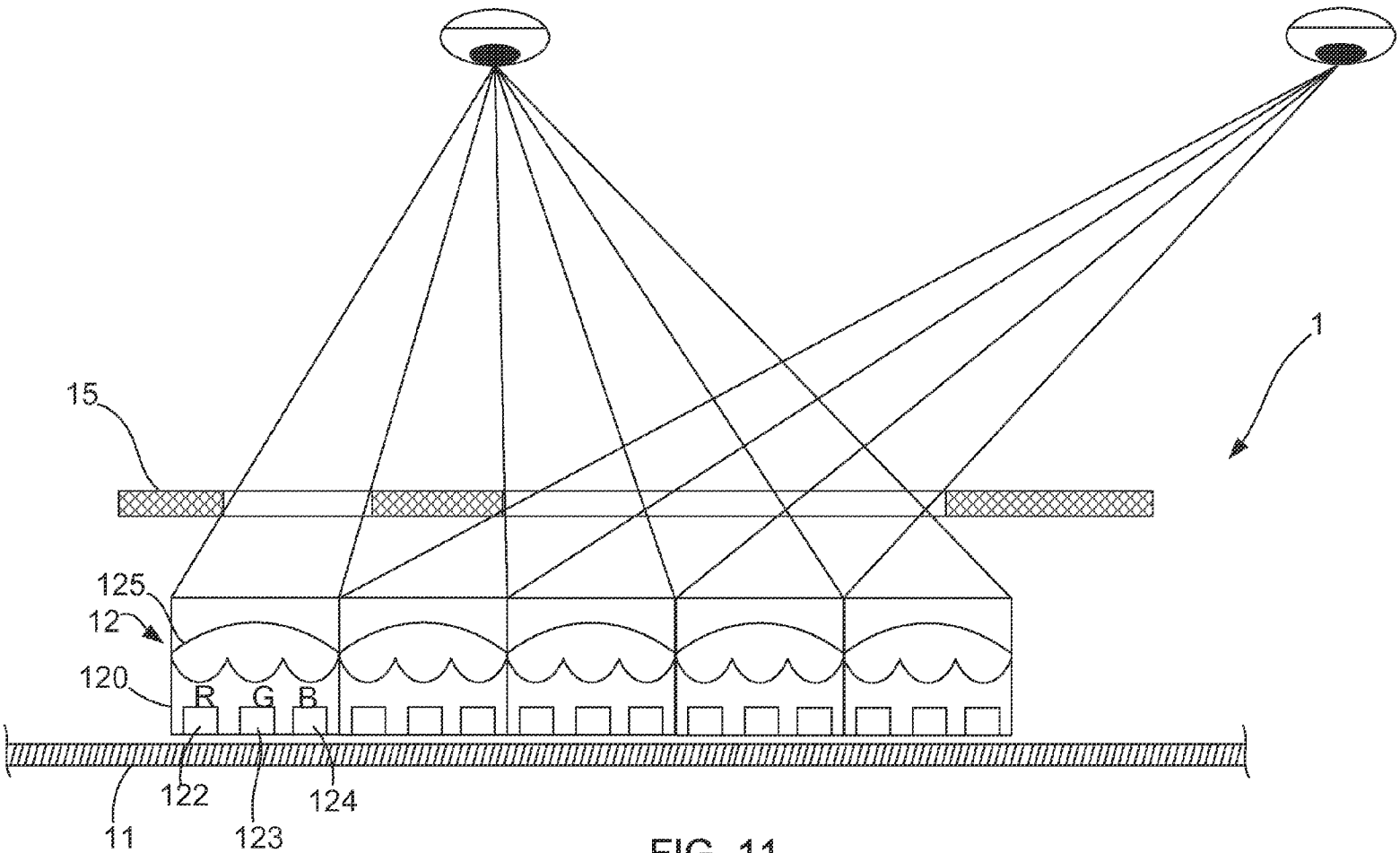
FIG. 11 is another cross-sectional side view of a color LED display device without color separation in accordance with the second preferred embodiment of the present invention.

With reference to FIGS. 10 and 11 for the other perspective view and cross-sectional side view of the color LED display device without color separation in accordance with the second preferred embodiment of the present invention respectively, if the parallax mask is used as the directional optical device assembly 15, then when the display unit 12 emits light, the red light R, the green light G and the blue light B will be combined on the two-dimensional plane, and the parallax mask (or the directional optical device assembly 15) will display images alternately. Now, the images alternately displayed by the parallax mask show longitudinal and latitudinal lines to produce the 3D image effect to naked eyes.

In summation of the description of the two preferred embodiments above, the color LED display device without color separation in accordance with the present invention has the following advantages:

1. The color LED display device without color separation of the present invention adds a micro optical device assembly installed above the red-light LED chip, the green-light LED chip and the blue-light LED chip in the display unit and uses the micro optical device assembly to refract and change the light paths of the red light, the green light and the blue light, such that the three color lights are combined on a two-dimensional plane to improve the color separation phenomenon of the conventional color LED display device.
2. Like the conventional color LED display device, the color LED display device without color separation comes with a simple structure and a low manufacturing cost while solving the problem of color separation, and thus the invention can be used extensively in areas such as TV walls, advertising billboards, and marquee displays.
3. The present invention further adds a directional optical device assembly installed above the display unit, such that the color LED display device can display 3D images.

What is claimed is:

1. A color LED display device without color separation, comprising:

a substrate, having a plurality of conductive wires laid thereon;

a plurality of display units, arranged in form of an array on the substrate, and coupled to the plurality of conductive wires, and each display unit comprising:

a driving chip;

at least one red-light LED chip, coupled to the driving chip for emitting a red light;

at least one green-light LED chip, coupled to the driving chip for emitting a green light;

at least one blue-light LED chip, coupled to the driving chip for emitting a blue light; and a micro optical device assembly, installed above the red-light LED chip, the green-light LED chip and the blue-light LED chip; wherein the micro optical device assembly is a bi-convex lens;

a power supply unit, coupled to the substrate, for supplying a power source to the plurality of display units; and a control unit, coupled to substrate, for controlling the plurality of display units to emit light; thereby, when the control unit controls the display unit to emit light, the red-light LED chip, the green-light LED chip and the blue-light LED chip emit red light, green light and blue light simultaneously, and the red light, the green light and the blue light pass through the micro optical device assembly to change their light paths, and the red light, the green light and the blue light are combined on a two-dimensional plane.

2. The color LED display device without color separation as recited in claim 1, further comprising a diffusing unit installed above the plurality of display units for increasing a light diffraction angle.

3. The color LED display device without color separation as recited in claim 1, wherein display unit further comprises a casing for containing the driving chip, the red-light LED chip, the green-light LED chip, the blue-light LED chip, and the micro optical device assembly.

4. The color LED display device without color separation as recited in claim 1, wherein the substrate is a circuit board.

5. The color LED display device without color separation as recited in claim 1, wherein the red-light LED chip is a red light LED chip or a red light OLED chip.

6. The color LED display device without color separation as recited in claim 1, wherein the green-light LED chip is a green light LED chip or a green light OLED chip.

7. The color LED display device without color separation as recited in claim 1, wherein the blue-light LED chip is a blue light LED chip or a blue light OLED chip.

8. The color LED display device without color separation as recited in claim 1, wherein the control unit is a computer, an input device or a handwriting input device.

9. The color LED display device without color separation as recited in claim 8, wherein the control unit further comprises a memory card access device for plugging in a memory.

10. A color LED display device without color separation, comprising:

a substrate, having a plurality of conductive circuits laid thereon;

a plurality of display units, arranged in form of an array on the substrate, and coupled to the plurality of conductive circuits, and each display unit comprising:

a driving chip;

at least one red-light LED chip, coupled to the driving chip for emitting a red light;

at least one green-light LED chip, coupled to the driving chip for emitting a green light;

at least one blue-light LED chip, coupled to the driving chip for emitting a blue light; and a micro optical device assembly, installed above the red-light LED chip, the green-light LED chip and the blue-light LED chip; wherein the micro optical device assembly is a bi-convex lens;

a power supply unit, coupled to the substrate, for supplying a power source to the plurality of display units;

a control unit, coupled to substrate, for controlling the plurality of display units to emit light; and a directional optical device assembly, installed above the plurality of display units; thereby, when the control unit controls the display unit to emit light, the red-light LED chip, the green-light LED chip and the blue-light LED chip emit red light, green light and blue light simultaneously, and the red light, the green light and the blue light pass through the micro optical device assembly and change their light paths, and the red light, the green light and the blue light are combined on a two-dimensional plane and emitted from the directional optical device assembly to the outside, and the red light, the green light and the blue light emitted from the directional optical device assembly produce an effect of a 3D image to naked eyes.

11. The color LED display device without color separation, as recited in claim 10, wherein the display unit a casing for containing the driving chip, the red-light LED chip, the green-light LED chip, the blue-light LED chip, and the micro optical device assembly.

12. The color LED display device without color separation, as recited in claim 10, wherein the substrate is a circuit board.

13. The color LED display device without color separation, as recited in claim 10, wherein the red-light LED chip is a red light LED chip or a red light OLED chip.

14. The color LED display device without color separation, as recited in claim 10, wherein the green-light LED chip is a green light LED chip or a green light OLED chip.

15. The color LED display device without color separation, as recited in claim 10, wherein the blue-light LED chip is a blue light LED chip or a blue light OLED chip.

16. The color LED display device without color separation, as recited in claim 10, wherein the control unit is a computer, an input device or a handwriting input device.

17. The color LED display device without color separation as recited in claim 16, wherein the control unit further comprises a memory card reader for plugging in a memory card.

18. The color LED display device without color separation, as recited in claim 10, wherein the directional optical device assembly is a micro-cylindrical lens array or a parallax mask.

* * * * *